US006215249B1

(12) United States Patent
Wu et al.

(10) Patent No.: US 6,215,249 B1
(45) Date of Patent: Apr. 10, 2001

(54) FLUORESCENT LAMP ASSEMBLY

(76) Inventors: Jong-Cherng Wu, 2F, No. 1, Lane 50, Ming-Shen St., Hsiao-Kang Dist., Kaohsiung City; Tyng-Jeng Sheu, No. 12, Alley 25, Lane 254, Shan-Chiao Rd., Niao-Sung Hsiang, Kaohsiung Hsien; Chia-Ming Hsu, No. 12, Alley 25, Lane 254, Shan-Chiao Rd., Niao-Sung Hsiang, Kaohsiung Hsien, all of (TW)

( * ) Notice: Subject to any disclaimer, the term of this patent is extended or adjusted under 35 U.S.C. 154(b) by 0 days.

(21) Appl. No.: 09/440,755

(22) Filed: Nov. 16, 1999

(51) Int. Cl.[7] ..... H05B 37/00

(52) U.S. Cl. ..... 315/86; 315/87

(58) Field of Search ..... 315/86, 87; 307/64, 307/85

(56) References Cited

U.S. PATENT DOCUMENTS 5,365,145 * 11/1994 Fields ..... 315/86

* cited by examiner

*Primary Examiner*—David Vu
(74) *Attorney, Agent, or Firm*—Merchant & Gould P.C.

(57) ABSTRACT

A fluorescent lamp assembly is adapted for connection with a power source, and includes a plurality of sets of fluorescent lamps, a plurality of control units and a main power switch. Each of the sets of fluorescent lamps has a lamp seat for holding the fluorescent lamps. The control units are adapted to be connected to the power source and are mounted on the lamp seats, respectively. Each of the control units is connected to a corresponding one of the sets of the fluorescent lamps in parallel for activating the corresponding set of the fluorescent lamps, and has a lamp switch for controlling activation of the corresponding set of the fluorescent lamps. The main power switch is connected to all of the control units and is adapted to be connected to the power source for controlling the power source to provide electrical power to all of the control units.

4 Claims, 8 Drawing Sheets

FLUORESCENT LAMP ASSEMBLY

BACKGROUND OF THE INVENTION

1. Field of the Invention

The invention relates to a fluorescent lamp assembly, more particularly to a fluorescent lamp assembly that has lamp switches for controlling activation of sets of fluorescent lamps.

2. Description of the Related Art

FIG. 1 illustrates a first conventional fluorescent lamp assembly for mounting on a ceiling (not shown). The first conventional fluorescent lamp assembly includes a plurality of sets 10 of fluorescent lamps 100, a plurality of control circuits 12 each connected to the power source (V1) and a corresponding one of the sets 10 of the fluorescent lamps 100 in parallel, and a power switch 14 connected to the power source (V1) and all of the control circuits 12. When one of the fluorescent lamps 100 fails, the power source (V1) must be shut down during replacement of the fluorescent lamp 100 to prevent any danger of electric shock. Since the power switch 14 is opened to provide an open circuit loop, the other fluorescent lamps 100 will not generate light, thereby resulting in inconvenience because replacement of damaged fluorescent lamps 100 is performed in dark.

FIGS. 2 and 3 illustrate a second conventional fluorescent lamp assembly 2 of the aforesaid type. The second conventional fluorescent lamp assembly 2 includes a power source 20, a power switch 201, sets 26 (only one is shown) of fluorescent lamps 261 and control circuits 27 (only one is shown). The second conventional fluorescent lamp assembly 2 further includes batteries 21, and test switches 28 (only one is shown). Each of the batteries 21 is connected to a corresponding one of the control circuits 27 and a corresponding one of sets 26 of the fluorescent lamps 261, and is disposed on a ceiling 22. Each of the test switches 28 is connected to the power switch 201 and a corresponding one of the control circuits 27. Each of the test switches 28 has a cord 23 extending downwardly. The batteries 21 can be tested to provide electrical power to the fluorescent lamps 26 by pulling the cords 23 with the use of a rod 25 having a hook portion 24 to open the test switches 28 and disconnect the power source 20 from the control circuits 27.

The following are some of the drawbacks of the aforesaid conventional fluorescent lamp assemblies:

1. When exchanging a broken fluorescent lamp 261, the power switches 14, 201 should be opened, thereby resulting in inconvenience due to the need to replace the lamps 100, 261 in the dark. In addition, the need to operate the power switches 14, 201, which are normally disposed on a wall far from lamps 100, 261, requires the operator to run back and forth between the lamps and the power switch during the lamp replacement operation.

2. When exchanging a worn battery, a part of the ceiling 22 should be detached for taking out the worn battery 21.

3. When testing -the batteries 21, the rod 25 should have the hook portion 24 for lugging the cords 23, thereby resulting in inconvenient operation.

SUMMARY OF THE INVENTION

The main object of the present invention is to provide an easy-to-maintain fluorescent lamp assembly having a lamp switch that can control directly a corresponding set of fluorescent lamps.

According to this invention, a fluorescent lamp assembly is adapted for connection with a power source, and includes a plurality of sets of fluorescent lamps, a plurality of control units and a main power switch.

Each of the sets of fluorescent lamps has a lamp seat for holding the fluorescent lamps.

The control units are adapted to be connected to the power source and are mounted on the lamp seats, respectively. Each of the control units is connected to a corresponding one of the sets of the fluorescent lamps in parallel for activating the corresponding set of the fluorescent lamps, and has a lamp switch for controlling activation of the corresponding set of the fluorescent lamps.

The main power switch is connected to all of the control units and is adapted to be connected to the power source for controlling the power source to provide electrical power to all of the control units.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
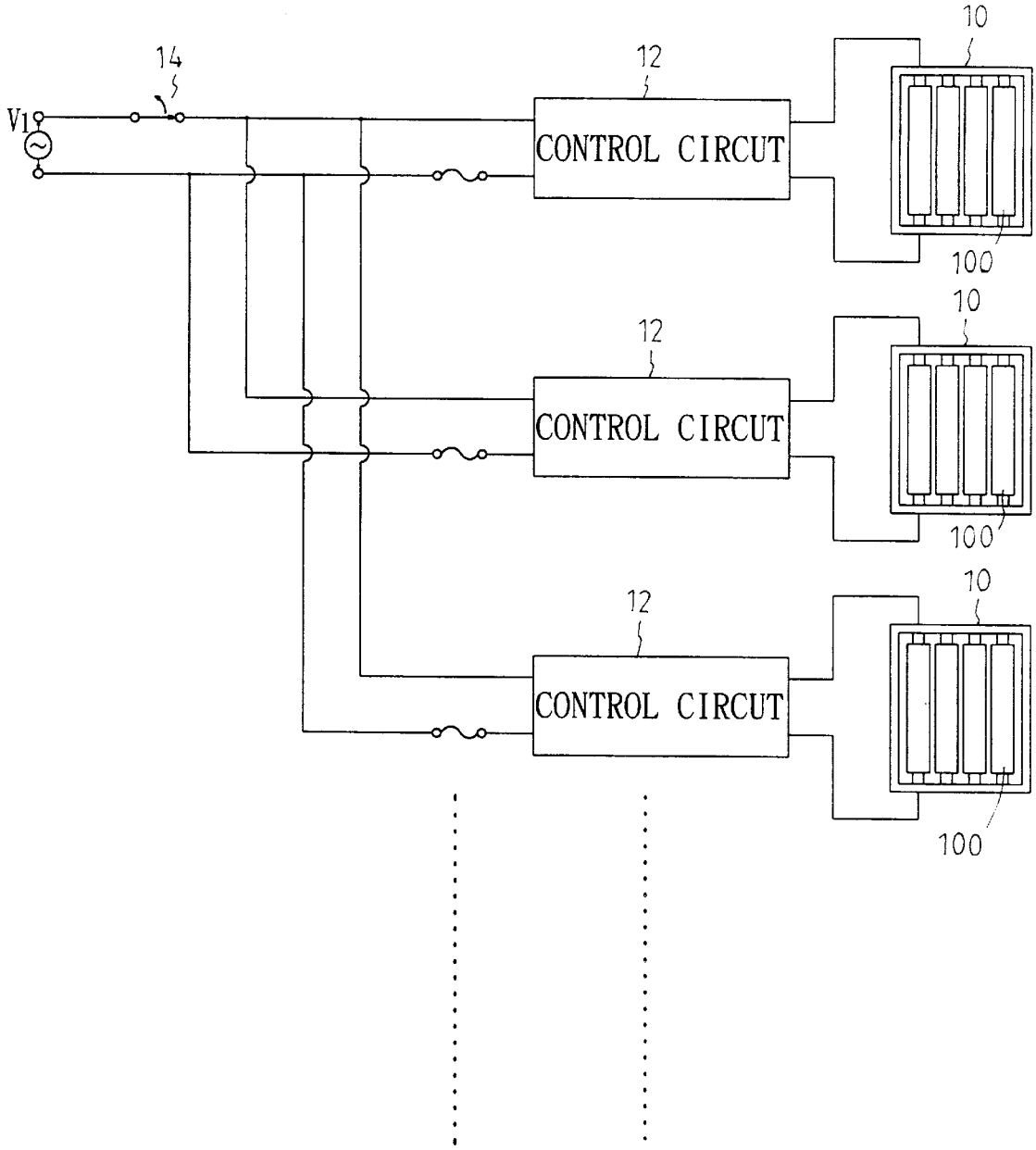
FIG.1 PRIOR ART
FIG. 1 is a circuit diagram of a conventional fluorescent lamp assembly.
Figure 2:
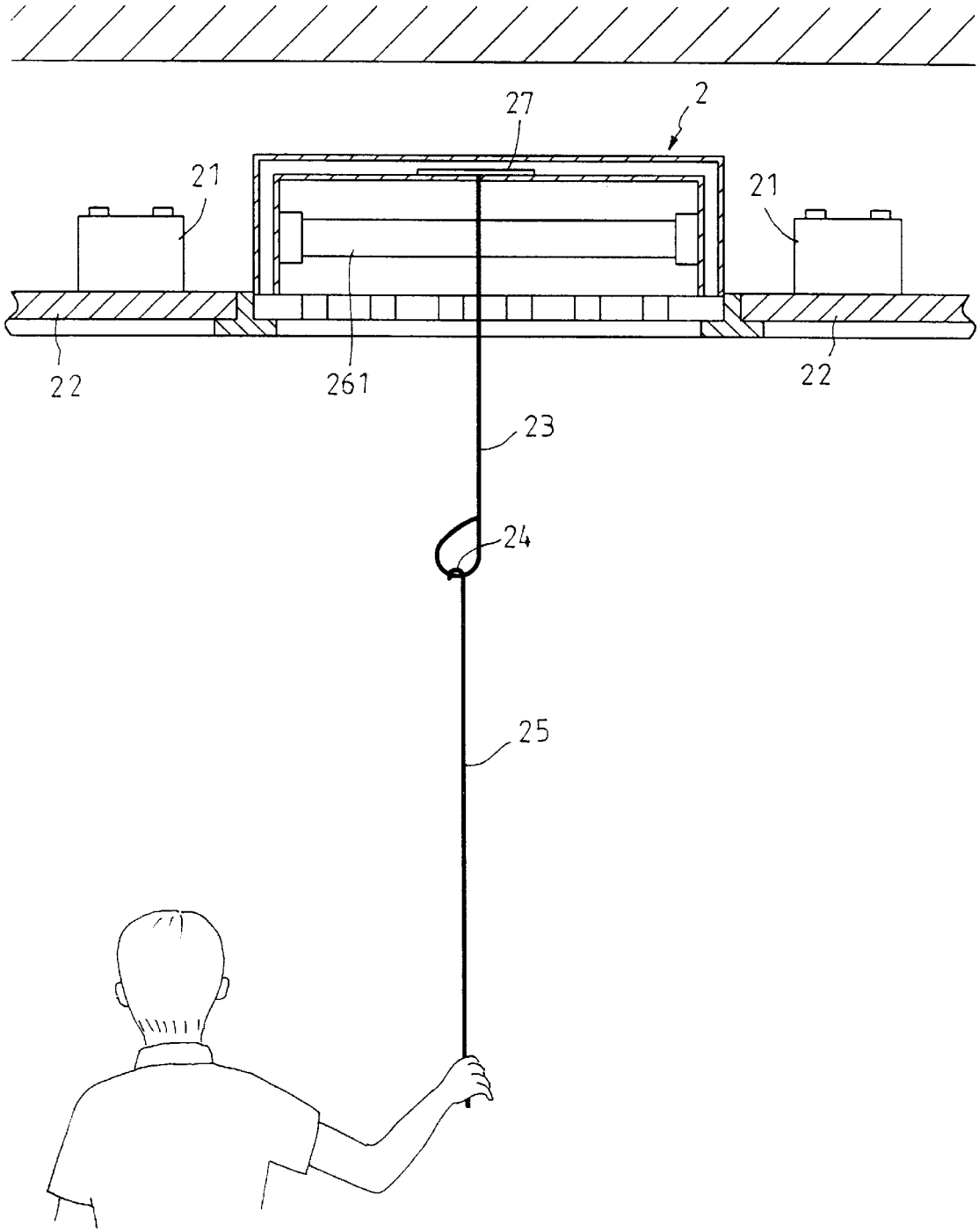
FIG. 2 PRIOR ART
FIG. 2 is a schematic partly sectional view of another conventional fluorescent lamp assembly when mounting on a ceiling.
Figure 3:
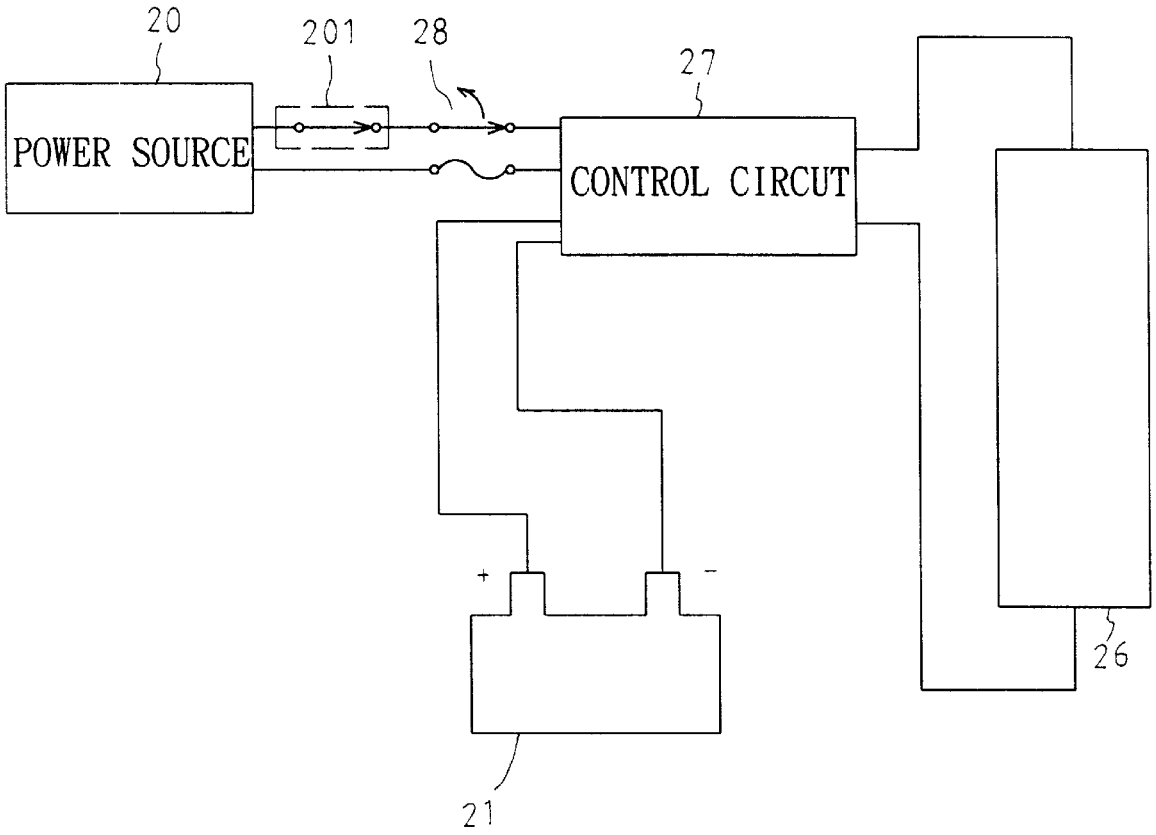
FIG. 3 PRIOR ART
FIG. 3 is a circuit diagram showing one of the sets of fluorescent lamps of the lamp assembly in FIG. 2.
Figure 4:
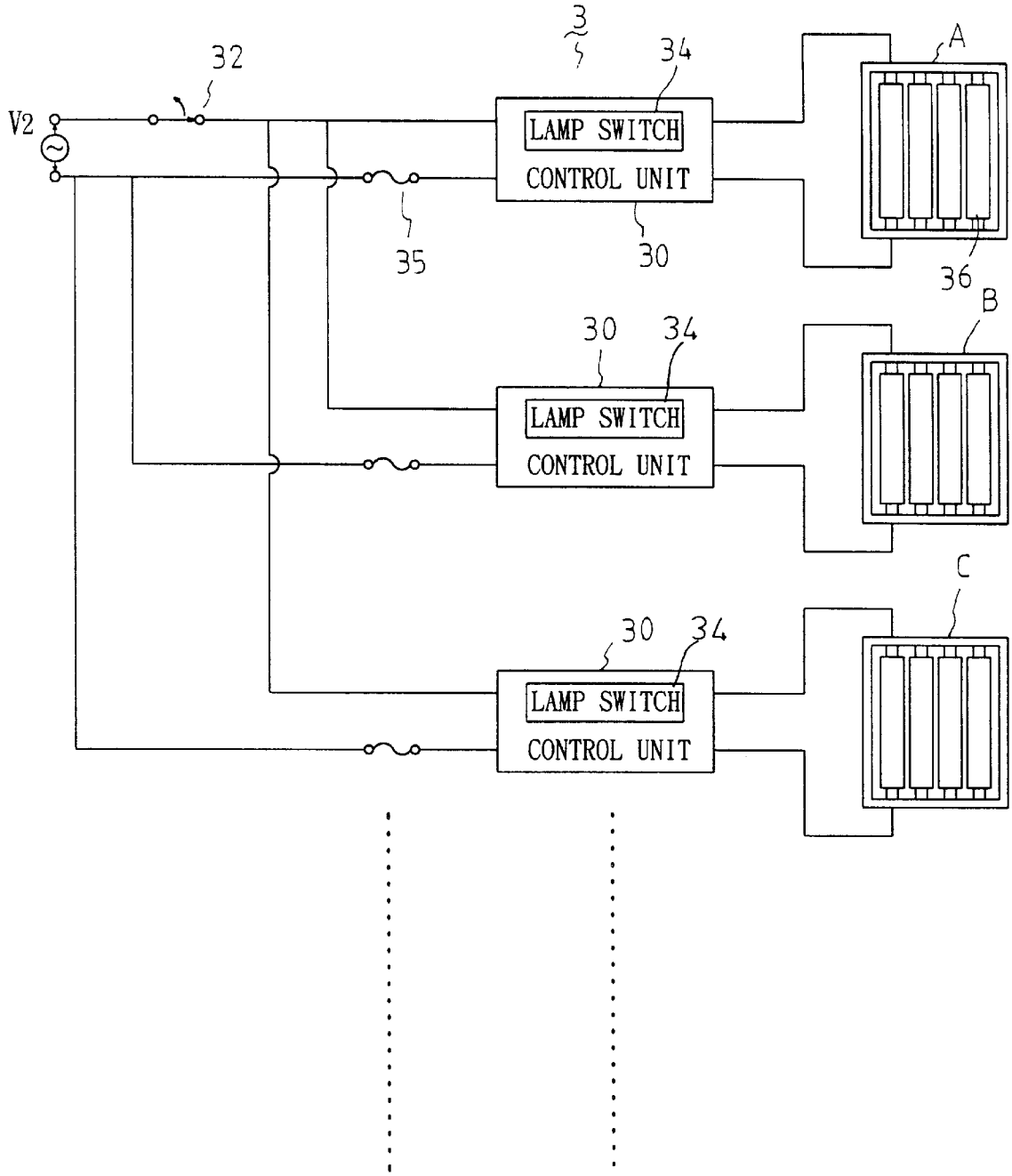
FIG. 4 is a circuit diagram showing the first preferred embodiment of a fluorescent lamp assembly according to the present invention.
Figure 5:
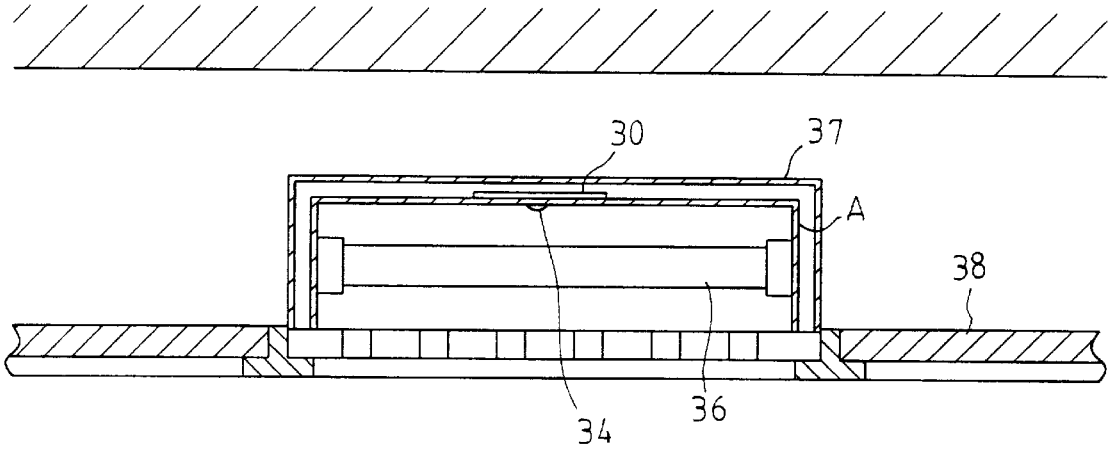
FIG. 5 is a schematic partly sectional view showing a lamp set of the first preferred embodiment when mounted on a ceiling.

Referring to FIGS. 4 and 5, the first preferred embodiment of a fluorescent lamp assembly (3) according to the present invention is shown to be adapted for connection with a power source (V2), and includes a plurality of sets (A, B, C, . . . ) of fluorescent lamps 36, a plurality of control units 30 and a main power switch 32.

Each of the sets (A, B, C, . . . ) of fluorescent lamps 36 has a lamp seat 37 mounted on a ceiling 38 for holding the fluorescent lamps 36.

The control units 30 are adapted to be connected to the power source (V2) and are mounted on the lamp seats 37, respectively. Each of the control units 30 is connected to a corresponding one of the sets (A, B, C, . . . ) of the fluorescent lamps 36 in parallel for activating the corresponding set of the fluorescent lamps 36, and has a lamp switch 34 for controlling activation of the corresponding set of the fluorescent lamps 36.

The main power switch 32 is connected to all of the control units 30 and is adapted to be connected to the power source (V2) for controlling the power source (V2) to provide electrical power to all of the control units 30.

The fluorescent lamp assembly 3 further includes a plurality of fuses 35. Each of the fuses 35 is connected between a corresponding one of the sets (A, B, C, . . . ) of the fluorescent lamps 36 and the power source (V2).

When one of the fluorescent lamps 36 in the set (A) breaks down, the lamp switch 34 can be opened to form an open circuit loop without operating the power switch 32 such that the broken fluorescent lamp 36 can be replaced safely and such that the other sets (B, C, . . . ) of the fluorescent lamps 36 can still generate light.

Figure 6:
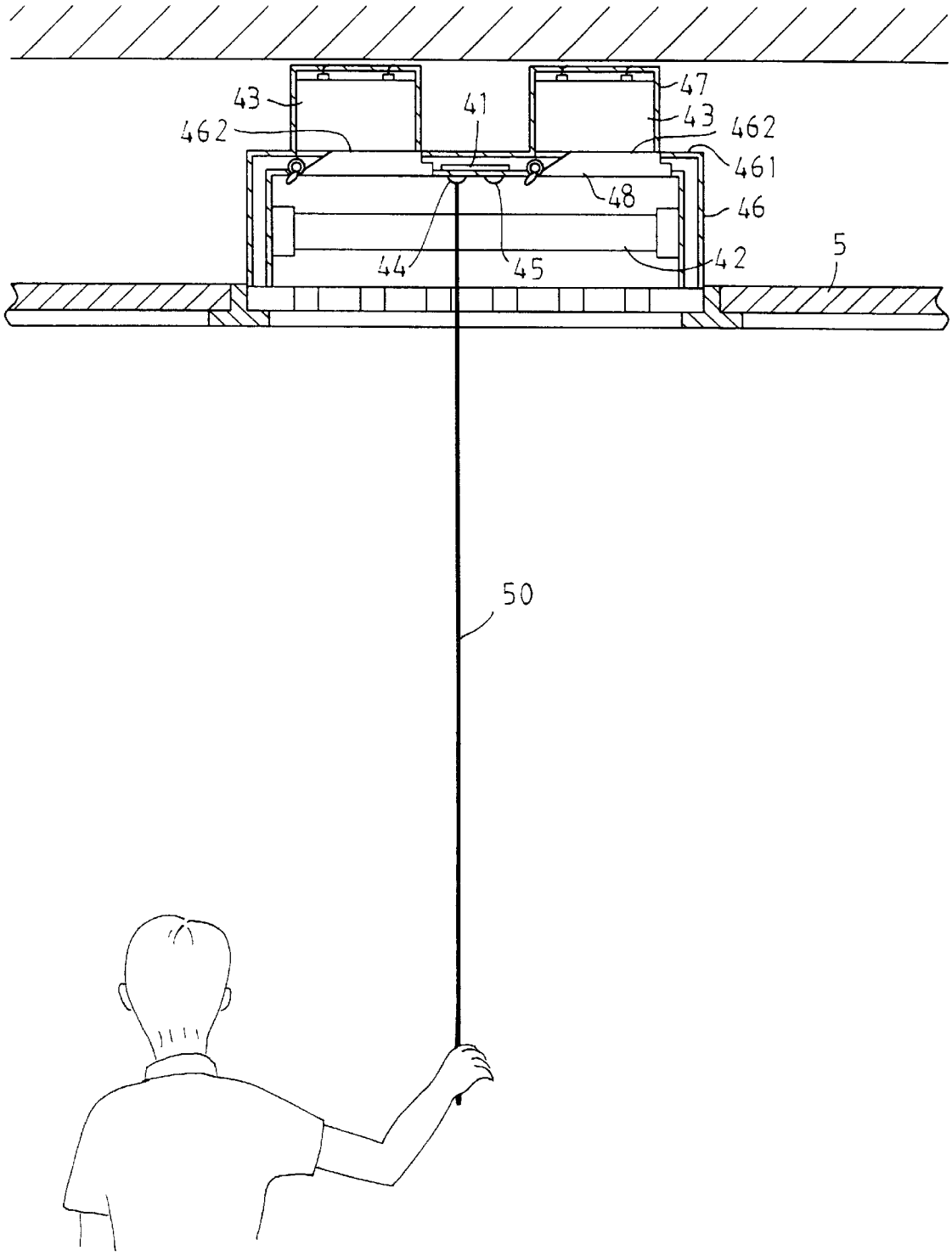
FIG. 6 is a schematic partly sectional view showing a lamp set of the second preferred embodiment of a fluorescent lamp assembly according to the present invention when mounted on a ceiling.
Figure 7:
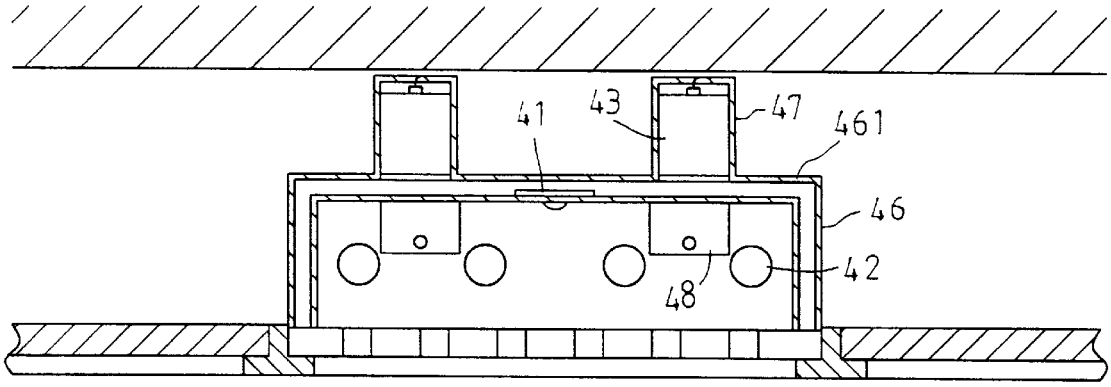
FIG. 7 is another schematic partly sectional view of a lamp set of the second preferred embodiment.
Figure 8:
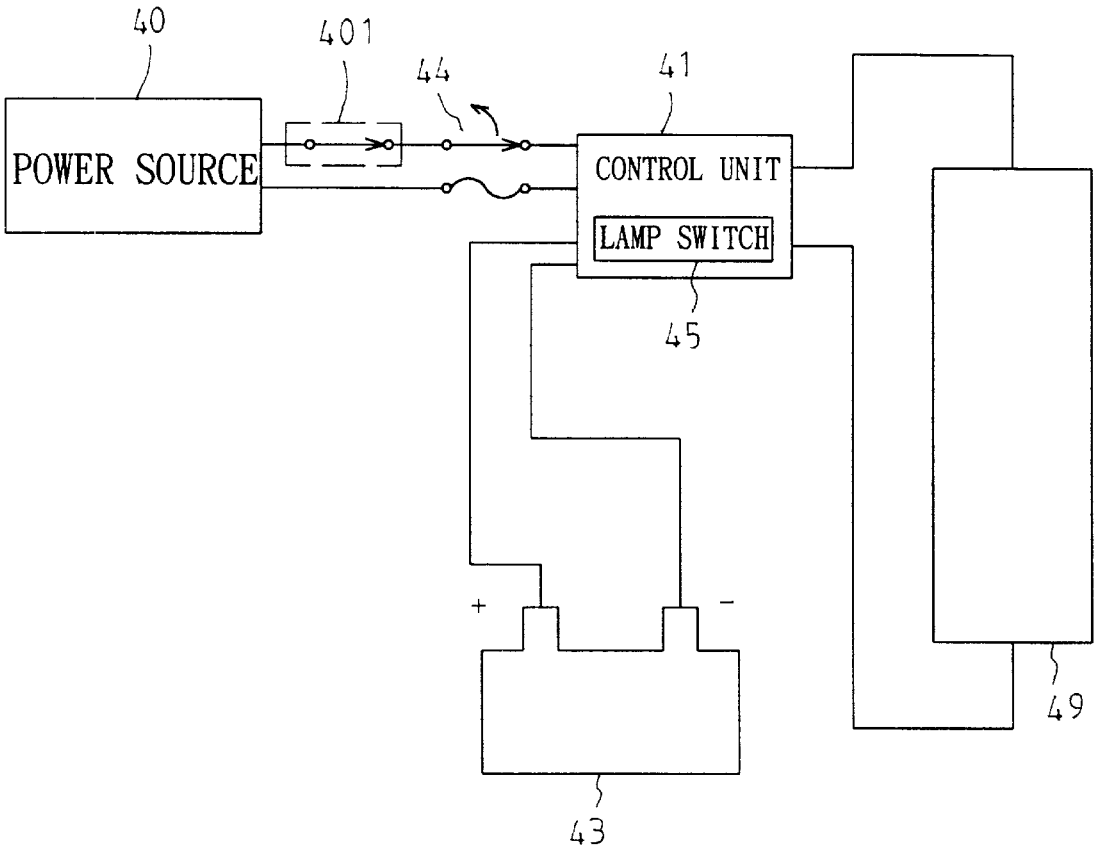
FIG. 8 is a circuit diagram showing one of the sets of fluorescent lamps of the second preferred embodiment.

FIGS. 6 to 8 illustrate the second preferred embodiment of a fluorescent lamp assembly according to the present invention, which is based on the first preferred embodiment. In this embodiment, the fluorescent lamp assembly includes a plurality of sets 49 (only one is shown) of four fluorescent lamps 42 adapted to be connected to a power source 40 in parallel, a plurality of control units 41 (only one is shown), and a main power switch 44. Each of the sets 49 has a lamp seat 46 for holding the fluorescent lamps 42.

Each of the sets 49 of the fluorescent lamps 42 further includes two casings 47, a battery unit having two batteries 43, and a test switch 44. Each of the casings 47 is mounted on the corresponding lamp seat 46, which is mounted on a ceiling 5. Each of the batteries 42 is disposed in a corresponding one of the casings 47. Each of the battery units is connected to a corresponding one of the control units 41 to supply electrical power to the corresponding one of the control units 41 in a known manner when the power source 40 is shut down. Each of the lamp seats 46 has a top wall 461 with two apertures 462. Each of the casings 47 is disposed above and is mounted on the top wall 461, and opens at a respective aperture 462. Each of the top walls 461 has two openable covers 48 to close the apertures 47, respectively. The test switch 44 is connected to the main power switch 401 and the corresponding control unit 41 and is operable to control the corresponding control unit 41 to receive electrical power from the corresponding one of the battery units even though the power source 40 is not shut down. The test switch 44 is a push button switch which is disposed on the top wall 461 of the corresponding lamp seat 46, as shown in FIG. 7. The test switch 44 can be easily operated with the use of a rod 50, as shown in FIG. 6.

When one of the fluorescent lamps 42 breaks down, a corresponding lamp switch 45 can be opened to form an open circuit loop without operating the power switch 44 such that the broken fluorescent lamp 42 can be replaced safely and such that the other fluorescent lamps 42 can still generate light. Furthermore, the batteries 43 can be easily replaced by opening the covers 48. The object of the invention is thus met.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

We claim:

1. A fluorescent lamp assembly for connection with a power source, comprising:

a plurality of sets of fluorescent lamps, each of said sets of said fluorescent lamps having a lamp seat for holding said fluorescent lamps;

a plurality of control units configured to be connected to the power source in parallel and mounted on said lamp seats, respectively, each of said control units being connected to a corresponding one of said sets of said fluorescent lamps in parallel for activating the corresponding set of said fluorescent lamps and having a lamp switch for controlling activation of the corresponding set of said fluorescent lamps; and a main power switch connected to all of said control units and configured to be connected to the power source for controlling the power source to provide electrical power to all of said control units.

2. The fluorescent lamp assembly as claimed in claim 1, further comprising a plurality of casings each mounted on a corresponding one of said lamp seats, a plurality of batteries each disposed in a corresponding one of said casings and connected to a corresponding one of said control units to supply electrical power to the corresponding one of said control units when the power source is shut down, and a plurality of test switches each connected to said main power switch and the corresponding one of said control units and operable so as to control the corresponding one of said control units to receive electrical power from a corresponding one of said batteries even though the power source is not shut down.

3. The fluorescent lamp assembly as claimed in claim 2, wherein each of said lamp seats has a top wall with an aperture, each of said casings being disposed above and being mounted on said top wall of the corresponding one of said lamp seats and opening at said aperture, said top wall of the corresponding one of said lamp seats having an openable cover to close said aperture.

4. The fluorescent lamp assembly as claimed in claim 3, wherein each of said test switches is a push button switch which is disposed on said top wall of the corresponding one of said lamp seats.

* * * * *